US006584438B1

(12) United States Patent
Manjunath et al.

(10) Patent No.: US 6,584,438 B1
(45) Date of Patent: Jun. 24, 2003

(54) FRAME ERASURE COMPENSATION METHOD IN A VARIABLE RATE SPEECH CODER

(75) Inventors: Sharath Manjunath, Bangalore (IN); Pengjun Huang, San Diego, CA (US); Eddie-Lun Tik Choy, Carlsbad, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 09/557,283

(22) Filed: Apr. 24, 2000

(51) Int. Cl.[7] ..... G10L 13/00

(52) U.S. Cl. ..... 704/228; 704/207; 704/230; 704/265

(58) Field of Search ..... 704/228, 207, 704/230, 265

(56) References Cited

U.S. PATENT DOCUMENTS 4,710,960 A 12/1987 Sato ..... 704/219
5,550,543 A * 8/1996 Chen et al. ..... 341/94
5,699,478 A * 12/1997 Nahumi ..... 704/226
5,884,253 A * 3/1999 Kleijn ..... 704/223
6,408,267 B1 * 6/2002 Proust ..... 704/210

FOREIGN PATENT DOCUMENTS

EP 0731448 9/1996 ..... 704/226

* cited by examiner

*Primary Examiner*—Marsha D. Banks-Harold
*Assistant Examiner*—Donald L. Storm
(74) *Attorney, Agent, or Firm*—Philip Wadsworth; Kent Baker; Thomas R. Rouse

(57) ABSTRACT

A frame erasure compensation method in a variable-rate speech coder includes quantizing, with a first encoder, a pitch lag value for a current frame and a first delta pitch lag value equal to the difference between the pitch lag value for the current frame and the pitch lag value for the previous frame. A second, predictive encoder quantizes only a second delta pitch lag value for the previous frame (equal to the difference between the pitch lag value for the previous frame and the pitch lag value for the frame prior to that frame). If the frame prior to the previous frame is processed as a frame erasure, the pitch lag value for the previous frame is obtained by subtracting the first delta pitch lag value from the pitch lag value for the current frame. The pitch lag value for the erasure frame is then obtained by subtracting the second delta pitch lag value from the pitch lag value for the previous frame. Additionally, a waveform interpolation method may be used to smooth discontinuities caused by changes in the coder pitch memory.

27 Claims, 11 Drawing Sheets

PSTN
18
MSC
16
BSC
14
BS
12
BS
12
BS
12
10
10
10

FRAME ERASURE COMPENSATION METHOD IN A VARIABLE RATE SPEECH CODER

BACKGROUND OF THE INVENTION

I. Field of the Invention

The present invention pertains generally to the field of speech processing, and more specifically to methods and apparatus for compensating for frame erasures in variable-rate speech coders.

II. Background

Transmission of voice by digital techniques has become widespread, particularly in long distance and digital radio telephone applications. This, in turn, has created interest in determining the least amount of information that can be sent over a channel while maintaining the perceived quality of the reconstructed speech. If speech is transmitted by simply sampling and digitizing, a data rate on the order of sixty-four kilobits per second (kbps) is required to achieve a speech quality of conventional analog telephone. However, through the use of speech analysis, followed by the appropriate coding, transmission, and resynthesis at the receiver, a significant reduction in the data rate can be achieved.

Devices for compressing speech find use in many fields of telecommunications. An exemplary field is wireless communications. The field of wireless communications has many applications including, e.g., cordless telephones, paging, wireless local loops, wireless telephony such as cellular and PCS telephone systems, mobile Internet Protocol (IP) telephony, and satellite communication systems. A particularly important application is wireless telephony for mobile subscribers.

Various over-the-air interfaces have been developed for wireless communication systems including, e.g., frequency division multiple access (FDMA), time division multiple access (TDMA), and code division multiple access (CDMA). In connection therewith, various domestic and international standards have been established including, e.g., Advanced Mobile Phone Service (AMPS), Global System for Mobile Communications (GSM), and Interim Standard 95 (IS-95). An exemplary wireless telephony communication system is a code division multiple access (CDMA) system. The IS-95 standard and its derivatives, IS-95A, ANSI J-STD-008, IS-95B, proposed third generation standards IS-95C and IS-2000, etc. (referred to collectively herein as IS-95), are promulgated by the Telecommunication Industry Association (TIA) and other well known standards bodies to specify the use of a CDMA over-the-air interface for cellular or PCS telephony communication systems. Exemplary wireless communication systems configured substantially in accordance with the use of the IS-95 standard are described in U.S. Pat. Nos. 5,103,459 and 4,901,307, which are assigned to the assignee of the present invention and fully incorporated herein by reference.

Devices that employ techniques to compress speech by extracting parameters that relate to a model of human speech generation are called speech coders. A speech coder divides the incoming speech signal into blocks of time, or analysis frames. Speech coders typically comprise an encoder and a decoder. The encoder analyzes the incoming speech frame to extract certain relevant parameters, and then quantizes the parameters into binary representation, i.e., to a set of bits or a binary data packet. The data packets are transmitted over the communication channel to a receiver and a decoder. The decoder processes the data packets, unquantizes them to produce the parameters, and resynthesizes the speech frames using the unquantized parameters.

The function of the speech coder is to compress the digitized speech signal into a low-bit-rate signal by removing all of the natural redundancies inherent in speech. The digital compression is achieved by representing the input speech frame with a set of parameters and employing quantization to represent the parameters with a set of bits. If the input speech frame has a number of bits $N_i$ and the data packet produced by the speech coder has a number of bits $N_o$, the compression factor achieved by the speech coder is $C_r=N_i/N_o$. The challenge is to retain high voice quality of the decoded speech while achieving the target compression factor. The performance of a speech coder depends on (1) how well the speech model, or the combination of the analysis and synthesis process described above, performs, and (2) how well the parameter quantization process is performed at the target bit rate of $N_o$ bits per frame. The goal of the speech model is thus to capture the essence of the speech signal, or the target voice quality, with a small set of parameters for each frame.

Perhaps most important in the design of a speech coder is the search for a good set of parameters (including vectors) to describe the speech signal. A good set of parameters requires a low system bandwidth for the reconstruction of a perceptually accurate speech signal. Pitch, signal power, spectral envelope (or formants), amplitude spectra, and phase spectra are examples of the speech coding parameters.

Speech coders may be implemented as time-domain coders, which attempt to capture the time-domain speech waveform by employing high time-resolution processing to encode small segments of speech (typically 5 millisecond (ms) subframes) at a time. For each subframe, a high-precision representative from a codebook space is found by means of various search algorithms known in the art. Alternatively, speech coders may be implemented as frequency-domain coders, which attempt to capture the short-term speech spectrum of the input speech frame with a set of parameters (analysis) and employ a corresponding synthesis process to recreate the speech waveform from the spectral parameters. The parameter quantizer preserves the parameters by representing them with stored representations of code vectors in accordance with known quantization techniques described in A. Gersho & R. M. Gray, *Vector Quantization and Signal Compression* (1992).

A well-known time-domain speech coder is the Code Excited Linear Predictive (CELP) coder described in L. B. Rabiner & R. W. Schafer, *Digital Processing of Speech Signals* 396–453 (1978), which is fully incorporated herein by reference. In a CELP coder, the short term correlations, or redundancies, in the speech signal are removed by a linear prediction (LP) analysis, which finds the coefficients of a short-term formant filter. Applying the short-term prediction filter to the incoming speech frame generates an LP residue signal, which is further modeled and quantized with long-term prediction filter parameters and a subsequent stochastic codebook. Thus, CELP coding divides the task of encoding the time-domain speech waveform into the separate tasks of encoding the LP short-term filter coefficients and encoding the LP residue. Time-domain coding can be performed at a fixed rate (i.e., using the same number of bits, $N_0$, for each frame) or at a variable rate (in which different bit rates are used for different types of frame contents). Variable-rate coders attempt to use only the amount of bits needed to encode the codec parameters to a level adequate to obtain a target quality. An exemplary variable rate CELP coder is described in U.S. Pat. No. 5,414,796, which is assigned to the assignee of the present invention and fully incorporated herein by reference.

Time-domain coders such as the CELP coder typically rely upon a high number of bits, $N_0$, per frame to preserve the accuracy of the time-domain speech waveform. Such coders typically deliver excellent voice quality provided the number of bits, $N_0$, per frame is relatively large (e.g., 8 kbps or above). However, at low bit rates (4 kbps and below), time-domain coders fail to retain high quality and robust performance due to the limited number of available bits. At low bit rates, the limited codebook space clips the waveform-matching capability of conventional time-domain coders, which are so successfully deployed in higher-rate commercial applications. Hence, despite improvements over time, many CELP coding systems operating at low bit rates suffer from perceptually significant distortion typically characterized as noise.

There is presently a surge of research interest and strong commercial need to develop a high-quality speech coder operating at medium to low bit rates (i.e., in the range of 2.4 to 4 kbps and below). The application areas include wireless telephony, satellite communications, Internet telephony, various multimedia and voice-streaming applications, voice mail, and other voice storage systems. The driving forces are the need for high capacity and the demand for robust performance under packet loss situations. Various recent speech coding standardization efforts are another direct driving force propelling research and development of low-rate speech coding algorithms. A low-rate speech coder creates more channels, or users, per allowable application bandwidth, and a low-rate speech coder coupled with an additional layer of suitable channel coding can fit the overall bit-budget of coder specifications and deliver a robust performance under channel error conditions.

One effective technique to encode speech efficiently at low bit rates is multimode coding. An exemplary multimode coding technique is described in U.S. application Ser. No. 09/217,341, entitled VARIABLE RATE SPEECH CODING, filed Dec. 21, 1998, assigned to the assignee of the present invention, and fully incorporated herein by reference. Conventional multimode coders apply different modes, or encoding-decoding algorithms, to different types of input speech frames. Each mode, or encoding-decoding process, is customized to optimally represent a certain type of speech segment, such as, e.g., voiced speech, unvoiced speech, transition speech (e.g., between voiced and unvoiced), and background noise (silence, or nonspeech) in the most efficient manner. An external, open-loop mode decision mechanism examines the input speech frame and makes a decision regarding which mode to apply to the frame. The open-loop mode decision is typically performed by extracting a number of parameters from the input frame, evaluating the parameters as to certain temporal and spectral characteristics, and basing a mode decision upon the evaluation.

Coding systems that operate at rates on the order of 2.4 kbps are generally parametric in nature. That is, such coding systems operate by transmitting parameters describing the pitch-period and the spectral envelope (or formants) of the speech signal at regular intervals. Illustrative of these so-called parametric coders is the LP vocoder system.

LP vocoders model a voiced speech signal with a single pulse per pitch period. This basic technique may be augmented to include transmission information about the spectral envelope, among other things. Although LP vocoders provide reasonable performance generally, they may introduce perceptually significant distortion, typically characterized as buzz.

In recent years, coders have emerged that are hybrids of both waveform coders and parametric coders. Illustrative of these so-called hybrid coders is the prototype-waveform interpolation (PWI) speech coding system. The PWI coding system may also be known as a prototype pitch period (PPP) speech coder. A PWI coding system provides an efficient method for coding voiced speech. The basic concept of PWI is to extract a representative pitch cycle (the prototype waveform) at fixed intervals, to transmit its description, and to reconstruct the speech signal by interpolating between the prototype waveforms. The PWI method may operate either on the LP residual signal or on the speech signal. An exemplary PWI, or PPP, speech coder is described in U.S. application Ser. No. 09/217,494, entitled PERIODIC SPEECH CODING, filed Dec. 21, 1998, now U.S. Pat. No. 6,456,964 issued Oct. 24, 2002, assigned to the assignee of the present invention, and fully incorporated herein by reference. Other PWI, or PPP, speech coders are described in U.S. Pat. No. 5,884,253 and W. Bastiaan Kleijn & Wolfgang Granzow *Methods for Waveform Interpolation in Speech Coding, in* 1 *Digital Signal Processing* 215–230 (1991).

In most conventional speech coders, the parameters of a given pitch prototype, or of a given frame, are each individually quantized and transmitted by the encoder. In addition, a difference value is transmitted for each parameter. The difference value specifies the difference between the parameter value for the current frame or prototype and the parameter value for the previous frame or prototype. However, quantizing the parameter values and the difference values requires using bits (and hence bandwidth). In a low-bit-rate speech coder, it is advantageous to transmit the least number of bits possible to maintain satisfactory voice quality. For this reason, in conventional low-bit-rate speech coders, only the absolute parameter values are quantized and transmitted. It would be desirable to decrease the number of bits transmitted without decreasing the informational value. Accordingly, a quantization scheme that quantizes the difference between a weighted sum of the parameter values for previous frames and the parameter value for the current frame is described in a related U.S. application Ser. No. 09/557,282, filed Apr. 24, 2000, entitled "METHOD AND APPARATUS FOR PREDICTIVELY QUANTIZING VOICED SPEECH," assigned to the assignee of the present invention, and fully incorporated herein by reference.

Speech coders experience frame erasure, or packet loss, due to poor channel conditions. One solution used in conventional speech coders was to have the decoder simply repeat the previous frame in the event a frame erasure was received. An improvement is found in the use of an adaptive codebook, which dynamically adjusts the frame immediately following a frame erasure. A further refinement, the enhanced variable rate coder (EVRC), is standardized in the Telecommunication Industry Association Interim Standard EIA/TIA IS-127. The EVRC coder relies upon a correctly received, low-predictively encoded frame to alter in the coder memory the frame that was not received, and thereby improve the quality of the correctly received frame.

A problem with the EVRC coder, however, is that discontinuities between a frame erasure and a subsequent adjusted good frame may arise. For example, pitch pulses may be placed too close, or too far apart, as compared to their relative locations in the event no frame erasure had occurred. Such discontinuities may cause an audible click.

In general, speech coders involving low predictability (such as those described in the paragraph above) perform better under frame erasure conditions. However, as discussed, such speech coders require relatively higher bit rates. Conversely, a highly predictive speech coder can achieve a good quality of synthesized speech output (particularly for highly periodic speech such as voiced speech), but performs worse under frame erasure conditions. It would be desirable to combine the qualities of both types of speech coder. It would further be advantageous to provide a method of smoothing discontinuities between frame erasures and subsequent altered good frames. Thus, there is a need for a frame erasure compensation method that predictive coder performance in the event of frame erasures and smoothes discontinuities between frame erasures and subsequent good frames.

SUMMARY OF THE INVENTION

The present invention is directed to a frame erasure compensation method that improves predictive coder performance in the event of frame erasures and smoothes discontinuities between frame erasures and subsequent good frames. Accordingly, in one aspect of the invention, a method of compensating for a frame erasure in a speech coder is provided. The method advantageously includes quantizing a pitch lag value and a delta value for a current frame processed after an erased frame is declared, the delta value being equal to the difference between the pitch lag value for the current frame and a pitch lag value for a frame immediately preceding the current frame; quantizing a delta value for at least one frame prior to the current frame and after the frame erasure, wherein the delta value is equal to the difference between a pitch lag value for the at least one frame and a pitch lag value for a frame immediately preceding the at least one frame; and subtracting each delta value from the pitch lag value for the current frame to generate a pitch lag value for the erased frame.

In another aspect of the invention, a speech coder configured to compensate for a frame erasure is provided. The speech coder advantageously includes means for means for quantizing a pitch lag value and a delta value for a current frame processed after an erased frame is declared, the delta value being equal to the difference between the pitch lag value for the current frame and a pitch lag value for a frame immediately preceding the current frame; means for quantizing a delta value for at least one frame prior to the current frame and after the frame erasure, wherein the delta value is equal to the difference between a pitch lag value for the at least one frame and a pitch lag value for a frame immediately preceding the at least one frame; and means for subtracting each delta value from the pitch lag value for the current frame to generate a pitch lag value for the erased frame.

In another aspect of the invention, a subscriber unit configured to compensate for a frame erasure is provided. The subscriber unit advantageously includes a first speech coder configured to quantize a pitch lag value and a delta value for a current frame processed after an erased frame is declared, the delta value being equal to the difference between the pitch lag value for the current frame and a pitch lag value for a frame immediately preceding the current frame; a second speech coder configured to quantize a delta value for at least one frame prior to the current frame and after the frame erasure, wherein the delta value is equal to the difference between a pitch lag value for the at least one frame and a pitch lag value for a frame immediately preceding the at least one frame; and a control processor coupled to the first and second speech coders and configured to subtract each delta value from the pitch lag value for the current frame to generate a pitch lag value for the erased frame.

In another aspect of the invention, an infrastructure element configured to compensate for a frame erasure is provided. The infrastructure element advantageously includes a processor; and a storage medium coupled to the processor and containing a set of instructions executable by the processor to quantize a pitch lag value and a delta value for a current frame processed after an erased frame is declared, the delta value being equal to the difference between the pitch lag value for the current frame and a pitch lag value for a frame immediately preceding the current frame, quantize a delta value for at least one frame prior to the current frame and after the frame erasure, wherein the delta value is equal to the difference between a pitch lag value for the at least one frame and a pitch lag value for a frame immediately preceding the at least one frame, and subtract each delta value from the pitch lag value for the current frame to generate a pitch lag value for the erased frame.

DETAILED DESCRIPTION OF THE PREFERRED EMBODIMENTS

The exemplary embodiments described hereinbelow reside in a wireless telephony communication system configured to employ a CDMA over-the-air interface. Nevertheless, it would be understood by those skilled in the art that a method and apparatus for predictively coding voiced speech embodying features of the instant invention may reside in any of various communication systems employing a wide range of technologies known to those of skill in the art.

Figure 1:
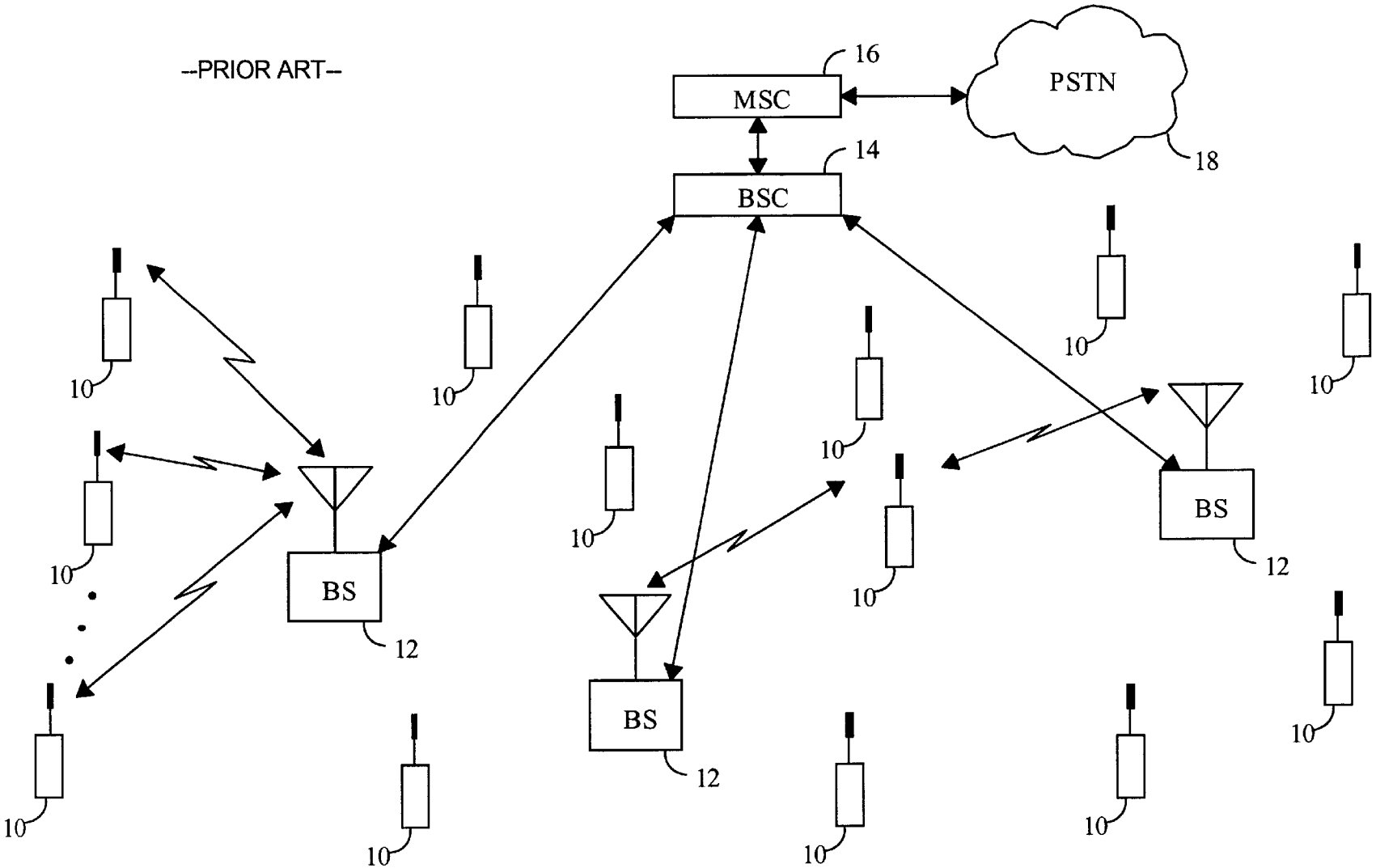
FIG. 1 is a block diagram of a wireless telephone system.

As illustrated in FIG. 1, a CDMA wireless telephone system generally includes a plurality of mobile subscriber units 10, a plurality of base stations 12, base station controllers (BSCs) 14, and a mobile switching center (MSC) 16.

The MSC 16 is configured to interface with a conventional public switch telephone network (PSTN) 18. The MSC 16 is also configured to interface with the BSCs 14. The BSCs 14 are coupled to the base stations 12 via backhaul lines. The backhaul lines may be configured to support any of several known interfaces including, e.g., E1/T1, ATM, IP, PPP, Frame Relay, HDSL, ADSL, or xDSL. It is understood that there may be more than two BSCs 14 in the system. Each base station 12 advantageously includes at least one sector (not shown), each sector comprising an omnidirectional antenna or an antenna pointed in a particular direction radially away from the base station 12. Alternatively, each sector may comprise two antennas for diversity reception. Each base station 12 may advantageously be designed to support a plurality of frequency assignments. The intersection of a sector and a frequency assignment may be referred to as a CDMA channel. The base stations 12 may also be known as base station transceiver subsystems (BTSs) 12. Alternatively, "base station" may be used in the industry to refer collectively to a BSC 14 and one or more BTSs 12. The BTSs 12 may also be denoted "cell sites" 12. Alternatively, individual sectors of a given BTS 12 may be referred to as cell sites. The mobile subscriber units 10 are typically cellular or PCS telephones 10. The system is advantageously configured for use in accordance with the IS-95 standard.

During typical operation of the cellular telephone system, the base stations 12 receive sets of reverse link signals from sets of mobile units 10. The mobile units 10 are conducting telephone calls or other communications. Each reverse link signal received by a given base station 12 is processed within that base station 12. The resulting data is forwarded to the BSC 14. The BSC 14 provides call resource allocation and mobility management functionality including the orchestration of soft handoffs between base stations 12. The BSC 14 also routes the received data to the MSC 16, which provides additional routing services for interface with the PSTN 18. Similarly, the PSTN 18 interfaces with the MSC 16, and the MSC 16 interfaces with the BSC 14, which in turn control the base stations 12 to transmit sets of forward link signals to sets of mobile units 10. It should be understood by those of skill that the subscriber units 10 may be fixed units in alternate embodiments.

Figure 2:
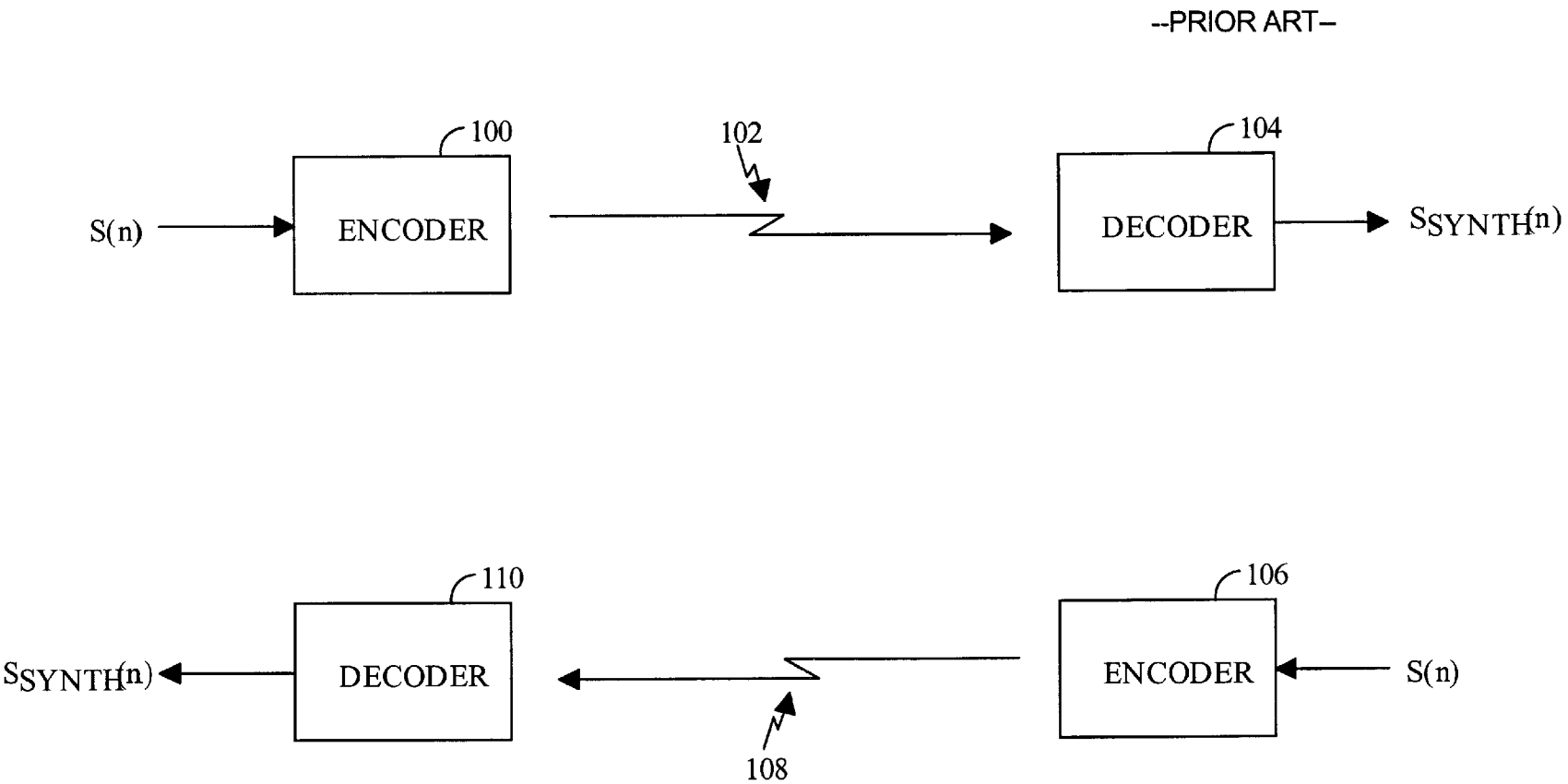
FIG. 2 is a block diagram of a communication channel terminated at each end by speech coders.

In FIG. 2 a first encoder 100 receives digitized speech samples s(n) and encodes the samples s(n) for transmission on a transmission medium 102, or communication channel 102, to a first decoder 104. The decoder 104 decodes the encoded speech samples and synthesizes an output speech signal $S_{SYNTH}(n)$. For transmission in the opposite direction, a second encoder 106 encodes digitized speech samples s(n), which are transmitted on a communication channel 108. A second decoder 110 receives and decodes the encoded speech samples, generating a synthesized output speech signal $S_{SYNTH}(n)$.

The speech samples s(n) represent speech signals that have been digitized and quantized in accordance with any of various methods known in the art including, e.g., pulse code modulation (PCM), companded $\mu$-law, or A-law. As known in the art, the speech samples s(n) are organized into frames of input data wherein each frame comprises a predetermined number of digitized speech samples s(n). In an exemplary embodiment, a sampling rate of 8 kHz is employed, with each 20 ms frame comprising 160 samples. In the embodiments described below, the rate of data transmission may advantageously be varied on a frame-by-frame basis from full rate to half rate to quarter rate to eighth rate. Varying the data transmission rate is advantageous because lower bit rates may be selectively employed for frames containing relatively less speech information. As understood by those skilled in the art, other sampling rates and/or frame sizes may be used. Also in the embodiments described below, the speech encoding (or coding) mode may be varied on a frame-by-frame basis in response to the speech information or energy of the frame.

The first encoder 100 and the second decoder 110 together comprise a first speech coder (encoder/decoder), or speech codec. The speech coder could be used in any communication device for transmitting speech signals, including, e.g., the subscriber units, BTSs, or BSCs described above with reference to FIG. 1. Similarly, the second encoder 106 and the first decoder 104 together comprise a second speech coder. It is understood by those of skill in the art that speech coders may be implemented with a digital signal processor (DSP), an application-specific integrated circuit (ASIC), discrete gate logic, firmware, or any conventional programmable software module and a microprocessor. The software module could reside in RAM memory, flash memory, registers, or any other form of storage medium known in the art. Alternatively, any conventional processor, controller, or state machine could be substituted for the microprocessor. Exemplary ASICs designed specifically for speech coding are described in U.S. Pat. No. 5,727,123, assigned to the assignee of the present invention and fully incorporated herein by reference, and U.S. application Ser. No. 08/197,417, entitled VOCODER ASIC, filed Feb. 16, 1994, now U.S. Pat. No. 5,784,532 issued Jul. 21, 1998, assigned to the assignee of the present invention, and fully incorporated herein by reference.

Figure 3:
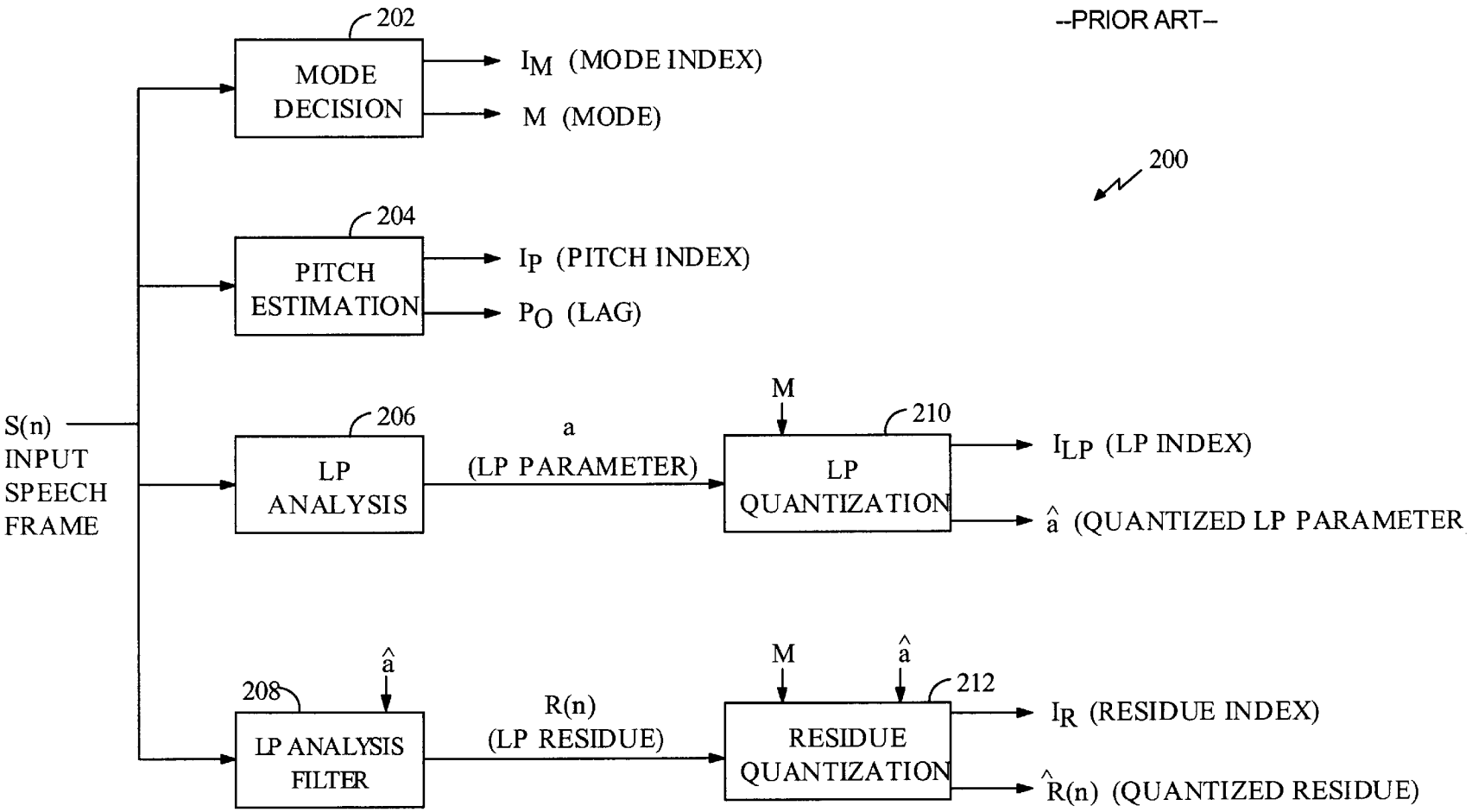
FIG. 3 is a block diagram of a speech encoder.

In FIG. 3 an encoder 200 that may be used in a speech coder includes a mode decision module 202, a pitch estimation module 204, an LP analysis module 206, an LP analysis filter 208, an LP quantization module 210, and a residue quantization module 212. Input speech frames s(n) are provided to the mode decision module 202, the pitch estimation module 204, the LP analysis module 206, and the LP analysis filter 208. The mode decision module 202 produces a mode index $I_M$ and a mode M based upon the periodicity, energy, signal-to-noise ratio (SNR), or zero crossing rate, among other features, of each input speech frame s(n). Various methods of classifying speech frames according to periodicity are described in U.S. Pat. No. 5,911,128, which is assigned to the assignee of the present invention and fully incorporated herein by reference. Such methods are also incorporated into the Telecommunication Industry Association Interim Standards TIA/EIA IS-127 and TIA/EIA IS-733. An exemplary mode decision scheme is also described in the aforementioned U.S. application Ser. No. 09/217,341.

The pitch estimation module 204 produces a pitch index $I_P$ and a lag value $P_0$ based upon each input speech frame s(n). The LP analysis module 206 performs linear predictive analysis on each input speech frame s(n) to generate an LP parameter a. The LP parameter a is provided to the LP quantization module 210. The LP quantization module 210 also receives the mode M, thereby performing the quantization process in a mode-dependent manner. The LP quantization module 210 produces an LP index $I_{LP}$ and a quantized LP parameter â. The LP analysis filter 208 receives the quantized LP parameter â in addition to the input speech frame s(n). The LP analysis filter 208 generates an LP residue signal R[n], which represents the error between the input speech frames s(n) and the reconstructed speech based on the quantized linear predicted parameters â. The LP residue R[n], the mode M, and the quantized LP parameter â are provided to the residue quantization module 212.

Based upon these values, the residue quantization module 212 produces a residue index $I_R$ and a quantized residue signal $\hat{R}[n]$.

Figure 4:
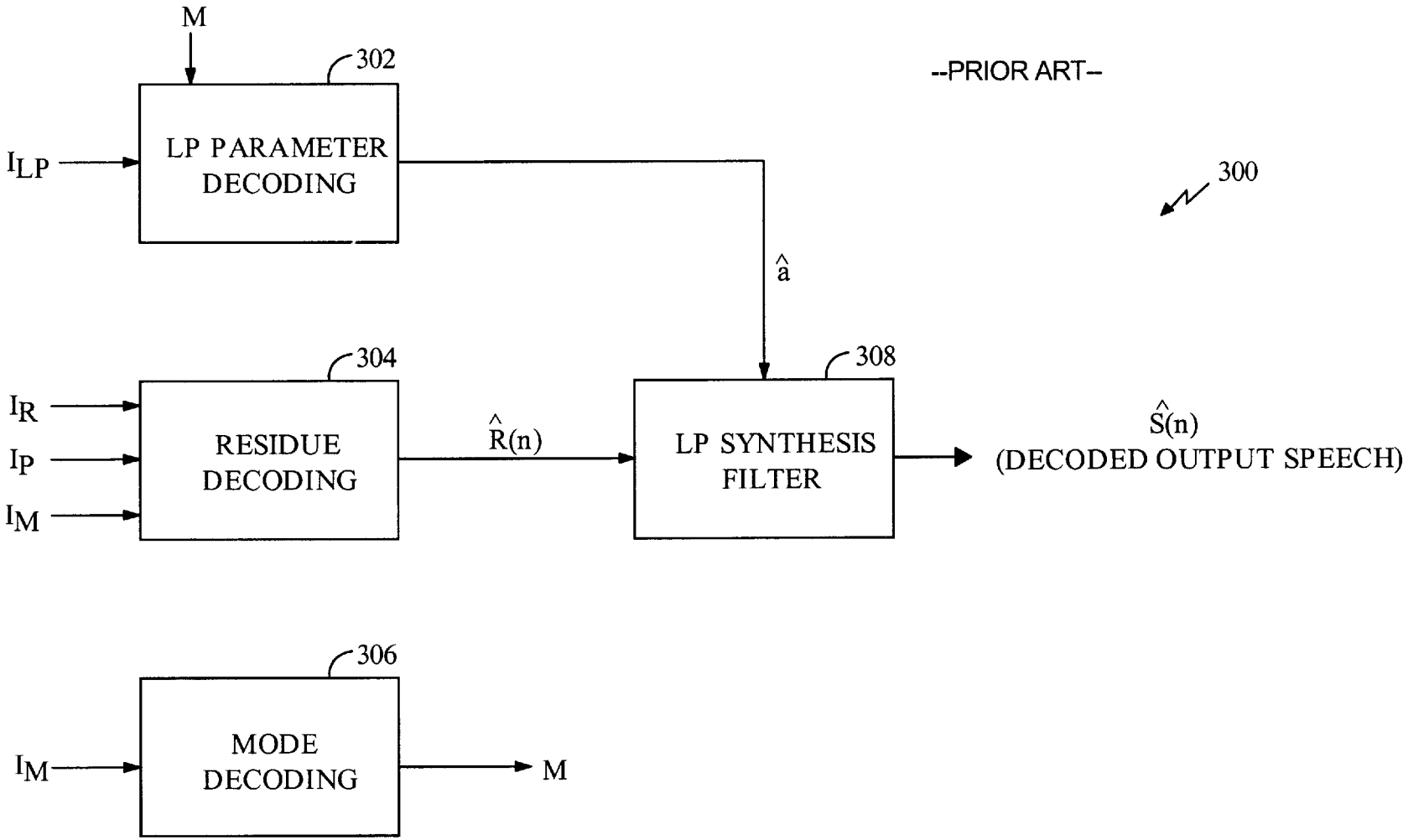
FIG. 4 is a block diagram of a speech decoder.

In FIG. 4 a decoder 300 that may be used in a speech coder includes an LP parameter decoding module 302, a residue decoding module 304, a mode decoding module 306, and an LP synthesis filter 308. The mode decoding module 306 receives and decodes a mode index $I_M$, generating therefrom a mode M. The LP parameter decoding module 302 receives the mode M and an LP index $I_{LP}$. The LP parameter decoding module 302 decodes the received values to produce a quantized LP parameter $\hat{a}$. The residue decoding module 304 receives a residue index $I_R$, a pitch index $I_P$, and the mode index $I_M$. The residue decoding module 304 decodes the received values to generate a quantized residue signal $\hat{R}[n]$. The quantized residue signal $\hat{R}[n]$ and the quantized LP parameter $\hat{a}$ are provided to the LP synthesis filter 308, which synthesizes a decoded output speech signal $\hat{s}[n]$ therefrom.

Operation and implementation of the various modules of the encoder 200 of FIG. 3 and the decoder 300 of FIG. 4 are known in the art and described in the aforementioned U.S. Pat. No. 5,414,796 and L. B. Rabiner & R. W. Schafer, *Digital Processing of Speech Signals* 396–453 (1978).

Figure 5:
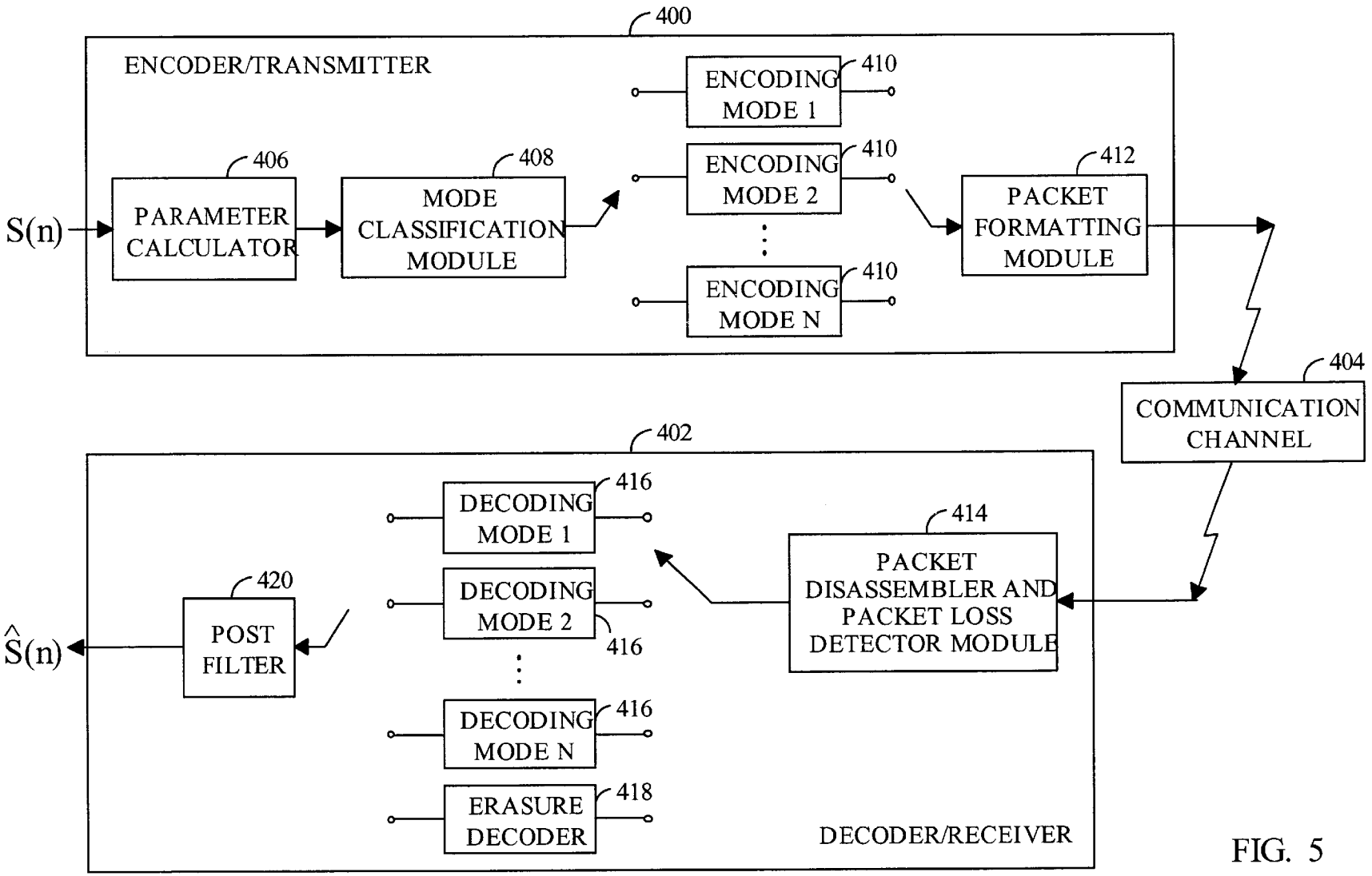
FIG. 5 is a block diagram of a speech coder including encoder/transmitter and decoder/receiver portions.

In one embodiment, illustrated in FIG. 5, a multimode speech encoder 400 communicates with a multimode speech decoder 402 across a communication channel, or transmission medium, 404. The communication channel 404 is advantageously an RF interface configured in accordance with the IS-95 standard. It would be understood by those of skill in the art that the encoder 400 has an associated decoder (not shown). The encoder 400 and its associated decoder together form a first speech coder. It would also be understood by those of skill in the art that the decoder 402 has an associated encoder (not shown). The decoder 402 and its associated encoder together form a second speech coder. The first and second speech coders may advantageously be implemented as part of first and second DSPs, and may reside in, e.g., a subscriber unit and a base station in a PCS or cellular telephone system, or in a subscriber unit and a gateway in a satellite system.

The encoder 400 includes a parameter calculator 406, a mode classification module 408, a plurality of encoding modes 410, and a packet formatting module 412. The number of encoding modes 410 is shown as n, which one of skill would understand could signify any reasonable number of encoding modes 410. For simplicity, only three encoding modes 410 are shown, with a dotted line indicating the existence of other encoding modes 410. The decoder 402 includes a packet disassembler and packet loss detector module 414, a plurality of decoding modes 416, an erasure decoder 418, and a post filter, or speech synthesizer, 420. The number of decoding modes 416 is shown as n, which one of skill would understand could signify any reasonable number of decoding modes 416. For simplicity, only three decoding modes 416 are shown, with a dotted line indicating the existence of other decoding modes 416.

A speech signal, s(n), is provided to the parameter calculator 406. The speech signal is divided into blocks of samples called frames. The value n designates the frame number. In an alternate embodiment, a linear prediction (LP) residual error signal is used in place of the speech signal. The LP residue is used by speech coders such as, e.g., the CELP coder. Computation of the LP residue is advantageously performed by providing the speech signal to an inverse LP filter (not shown). The transfer function of the inverse LP filter, A(z), is computed in accordance with the following equation:

$$A(z)=\mathbf{1}-a_1z^{-1}-a_2z^{-2}- \ldots -a_pz^{-p},$$

in which the coefficients $a_1$ are filter taps having predefined values chosen in accordance with known methods, as described in the aforementioned U.S. Pat. Nos. 5,414,796 and 6,456,964. The number p indicates the number of previous samples the inverse LP filter uses for prediction purposes. In a particular embodiment, p is set to ten.

The parameter calculator 406 derives various parameters based on the current frame. In one embodiment these parameters include at least one of the following: linear predictive coding (LPC) filter coefficients, line spectral pair (LSP) coefficients, normalized autocorrelation functions (NACFs), open-loop lag, zero crossing rates, band energies, and the formant residual signal. Computation of LPC coefficients, LSP coefficients, open-loop lag, band energies, and the formant residual signal is described in detail in the aforementioned U.S. Pat. No. 5,414,796. Computation of NACFs and zero crossing rates is described in detail in the aforementioned U.S. Pat. No. 5,911,128.

The parameter calculator 406 is coupled to the mode classification module 408. The parameter calculator 406 provides the parameters to the mode classification module 408. The mode classification module 408 is coupled to dynamically switch between the encoding modes 410 on a frame-by-frame basis in order to select the most appropriate encoding mode 410 for the current frame. The mode classification module 408 selects a particular encoding mode 410 for the current frame by comparing the parameters with predefined threshold and/or ceiling values. Based upon the energy content of the frame, the mode classification module 408 classifies the frame as nonspeech, or inactive speech (e.g., silence, background noise, or pauses between words), or speech. Based upon the periodicity of the frame, the mode classification module 408 then classifies speech frames as a particular type of speech, e.g., voiced, unvoiced, or transient.

Figure 6:
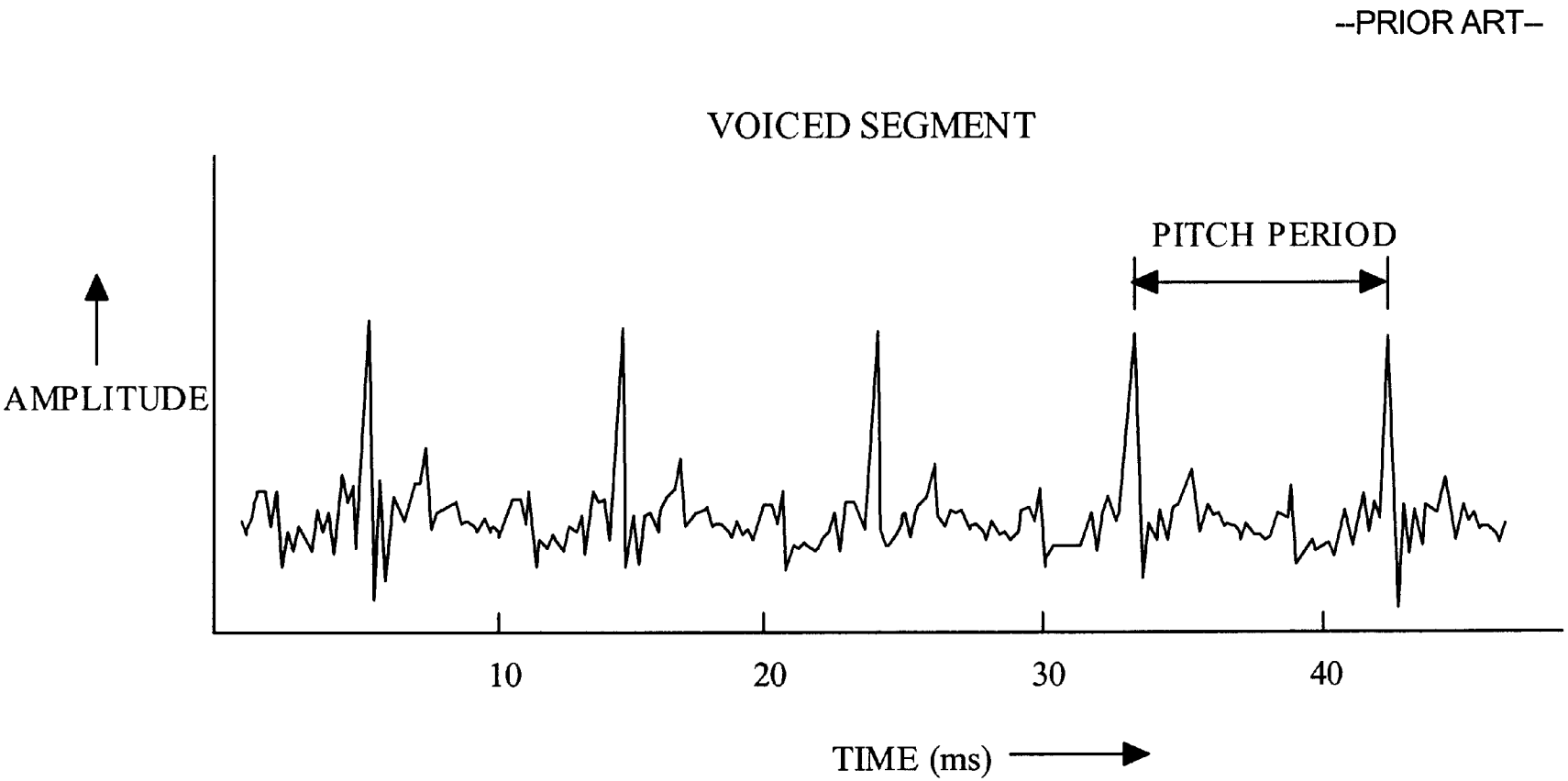
FIG. 6 is a graph of signal amplitude versus time for a segment of voiced speech.

Voiced speech is speech that exhibits a relatively high degree of periodicity. A segment of voiced speech is shown in the graph of FIG. 6. As illustrated, the pitch period is a component of a speech frame that may be used to advantage to analyze and reconstruct the contents of the frame. Unvoiced speech typically comprises consonant sounds. Transient speech frames are typically transitions between voiced and unvoiced speech. Frames that are classified as neither voiced nor unvoiced speech are classified as transient speech. It would be understood by those skilled in the art that any reasonable classification scheme could be employed.

Classifying the speech frames is advantageous because different encoding modes 410 can be used to encode different types of speech, resulting in more efficient use of bandwidth in a shared channel such as the communication channel 404. For example, as voiced speech is periodic and thus highly predictive, a low-bit-rate, highly predictive encoding mode 410 can be employed to encode voiced speech. Classification modules such as the classification module 408 are described in detail in the aforementioned U.S. application Ser. No. 09/217,341 and in U.S. application Ser. No. 09/259,151 entitled CLOSED-LOOP MULTIMODE MIXED-DOMAIN LINEAR PREDICTION (MDLP) SPEECH CODER, filed Feb. 26, 1999, assigned to the assignee of the present invention, and fully incorporated herein by reference.

The mode classification module 408 selects an encoding mode 410 for the current frame based upon the classification of the frame. The various encoding modes 410 are coupled in parallel. One or more of the encoding modes 410 may be operational at any given time. Nevertheless, only one encoding mode 410 advantageously operates at any given time, and is selected according to the classification of the current frame.

The different encoding modes 410 advantageously operate according to different coding bit rates, different coding schemes, or different combinations of coding bit rate and coding scheme. The various coding rates used may be full rate, half rate, quarter rate, and/or eighth rate. The various coding schemes used may be CELP coding, prototype pitch period (PPP) coding (or waveform interpolation (WI) coding), and/or noise excited linear prediction (NELP) coding. Thus, for example, a particular encoding mode 410 could be full rate CELP, another encoding mode 410 could be half rate CELP, another encoding mode 410 could be quarter rate PPP, and another encoding mode 410 could be NELP.

In accordance with a CELP encoding mode 410, a linear predictive vocal tract model is excited with a quantized version of the LP residual signal. The quantized parameters for the entire previous frame are used to reconstruct the current frame. The CELP encoding mode 410 thus provides for relatively accurate reproduction of speech but at the cost of a relatively high coding bit rate. The CELP encoding mode 410 may advantageously be used to encode frames classified as transient speech. An exemplary variable rate CELP speech coder is described in detail in the aforementioned U.S. Pat. No. 5,414,796.

In accordance with a NELP encoding mode 410, a filtered, pseudo-random noise signal is used to model the speech frame. The NELP encoding mode 410 is a relatively simple technique that achieves a low bit rate. The NELP encoding mode 410 may be used to advantage to encode frames classified as unvoiced speech. An exemplary NELP encoding mode is described in detail in the aforementioned U.S. Pat. No. 6,456,964.

In accordance with a PPP encoding mode 410, only a subset of the pitch periods within each frame are encoded. The remaining periods of the speech signal are reconstructed by interpolating between these prototype periods. In a time-domain implementation of PPP coding, a first set of parameters is calculated that describes how to modify a previous prototype period to approximate the current prototype period. One or more codevectors are selected which, when summed, approximate the difference between the current prototype period and the modified previous prototype period. A second set of parameters describes these selected codevectors. In a frequency-domain implementation of PPP coding, a set of parameters is calculated to describe amplitude and phase spectra of the prototype. This may be done either in an absolute sense or predictively. A method for predictively quantizing the amplitude and phase spectra of a prototype (or of an entire frame) is described in the aforementioned related U.S. application Ser. No. 09/557,282, filed Apr. 24, 2000, and entitled "METHOD AND APPARATUS FOR PREDICTIVELY QUANTIZING VOICED SPEECH." In accordance with either implementation of PPP coding, the decoder synthesizes an output speech signal by reconstructing a current prototype based upon the first and second sets of parameters. The speech signal is then interpolated over the region between the current reconstructed prototype period and a previous reconstructed prototype period. The prototype is thus a portion of the current frame that will be linearly interpolated with prototypes from previous frames that were similarly positioned within the frame in order to reconstruct the speech signal or the LP residual signal at the decoder (i.e., a past prototype period is used as a predictor of the current prototype period). An exemplary PPP speech coder is described in detail in the aforementioned U.S. Pat. No. 6,456,964.

Coding the prototype period rather than the entire speech frame reduces the required coding bit rate. Frames classified as voiced speech may advantageously be coded with a PPP encoding mode 410. As illustrated in FIG. 6, voiced speech contains slowly time-varying, periodic components that are exploited to advantage by the PPP encoding mode 410. By exploiting the periodicity of the voiced speech, the PPP encoding mode 410 is able to achieve a lower bit rate than the CELP encoding mode 410.

The selected encoding mode 410 is coupled to the packet formatting module 412. The selected encoding mode 410 encodes, or quantizes, the current frame and provides the quantized frame parameters to the packet formatting module 412. The packet formatting module 412 advantageously assembles the quantized information into packets for transmission over the communication channel 404. In one embodiment the packet formatting module 412 is configured to provide error correction coding and format the packet in accordance with the IS-95 standard. The packet is provided to a transmitter (not shown), converted to analog format, modulated, and transmitted over the communication channel 404 to a receiver (also not shown), which receives, demodulates, and digitizes the packet, and provides the packet to the decoder 402.

In the decoder 402, the packet disassembler and packet loss detector module 414 receives the packet from the receiver. The packet disassembler and packet loss detector module 414 is coupled to dynamically switch between the decoding modes 416 on a packet-by-packet basis. The number of decoding modes 416 is the same as the number of encoding modes 410, and as one skilled in the art would recognize, each numbered encoding mode 410 is associated with a respective similarly numbered decoding mode 416 configured to employ the same coding bit rate and coding scheme.

If the packet disassembler and packet loss detector module 414 detects the packet, the packet is disassembled and provided to the pertinent decoding mode 416. If the packet disassembler and packet loss detector module 414 does not detect a packet, a packet loss is declared and the erasure decoder 418 advantageously performs frame erasure processing as described in detail below.

The parallel array of decoding modes 416 and the erasure decoder 418 are coupled to the post filter 420. The pertinent decoding mode 416 decodes, or de-quantizes, the packet provides the information to the post filter 420. The post filter 420 reconstructs, or synthesizes, the speech frame, outputting synthesized speech frames, $\hat{s}(n)$. Exemplary decoding modes and post filters are described in detail in the aforementioned U.S. Pat. Nos. 5,414,796 and 6,456,964.

In one embodiment the quantized parameters themselves are not transmitted. Instead, codebook, indices specifying addresses in various lookup tables (LUTs) (not shown) in the decoder 402 are transmitted. The decoder 402 receives the codebook indices and searches the various codebook LUTs for appropriate parameter values. Accordingly, codebook indices for parameters such as, e.g., pitch lag, adaptive codebook gain, and LSP may be transmitted, and three associated codebook LUTs are searched by the decoder 402.

In accordance with the CELP encoding mode 410, pitch lag, amplitude, phase, and LSP parameters are transmitted. The LSP codebook indices are transmitted because the LP residue signal is to be synthesized at the decoder 402. Additionally, the difference between the pitch lag value for the current frame and the pitch lag value for the previous frame is transmitted.

In accordance with a conventional PPP encoding mode in which the speech signal is to be synthesized at the decoder, only the pitch lag, amplitude, and phase parameters are transmitted. The lower bit rate employed by conventional PPP speech coding techniques does not permit transmission of both absolute pitch lag information and relative pitch lag difference values.

In accordance with one embodiment, highly periodic frames such as voiced speech frames are transmitted with a low-bit-rate PPP encoding mode 410 that quantizes the difference between the pitch lag value for the current frame and the pitch lag value for the previous frame for transmission, and does not quantize the pitch lag value for the current frame for transmission. Because voiced frames are highly periodic in nature, transmitting the difference value as opposed to the absolute pitch lag value allows a lower coding bit rate to be achieved. In one embodiment this quantization is generalized such that a weighted sum of the parameter values for previous frames is computed, wherein the sum of the weights is one, and the weighted sum is subtracted from the parameter value for the current frame. The difference is then quantized. This technique is described in detail in the aforementioned related U.S. application Ser. No. 09/557,282, filed Apr. 24, 2000, and entitled "METHOD AND APPARATUS FOR PREDICTIVELY QUANTIZING VOICED SPEECH."

In accordance with one embodiment, a variable-rate coding system encodes different types of speech as determined by a control processor with different encoders, or encoding modes, controlled by the processor, or mode classifier. The encoders modify the current frame residual signal (or in the alternative, the speech signal) according to a pitch contour as specified by pitch lag value for the previous frame, $L_{-1}$, and the pitch lag value for the current frame, L. A control processor for the decoders follows the same pitch contour to reconstruct an adaptive codebook contribution, $\{P(n)\}$, from a pitch memory for the quantized residual or speech for the current frame.

If the previous pitch lag value, $L_{-1}$, is lost, the decoders cannot reconstruct the correct pitch contour. This causes the adaptive codebook contribution, $\{P(n)\}$, to be distorted. In turn, the synthesized speech will suffer severe degradation even though a packet is not lost for the current frame. As a remedy, some conventional coders employ a scheme to encode both L and the difference between L and $L_{-1}$. This difference, or delta pitch value may be denoted by $\Delta$, where $\Delta=L-L_{-1}$, serves the purpose of recovering $L_{-1}$ if $L_{-1}$ is lost in the previous frame.

The presently described embodiment may be used to best advantage in a variable-rate coding system. Specifically, a first encoder (or encoding mode), denoted by C, encodes the current frame pitch lag value, L, and the delta pitch lag value, $\Delta$, as described above. A second encoder (or encoding mode), denoted by Q, encodes the delta pitch lag value, $\Delta$, but does not necessarily encode the pitch lag value, L. This allows the second coder, Q, to use the additional bits to encode other parameters or to save the bits altogether (i.e., to function as a low-bit-rate coder). The first coder, C, may advantageously be a coder used to encode relatively non-periodic speech such as, e.g., a full rate CELP coder. The second coder, Q, may advantageously be a coder used to encode highly periodic speech (e.g., voiced speech) such as, e.g., a quarter rate PPP coder.

Figure 7:
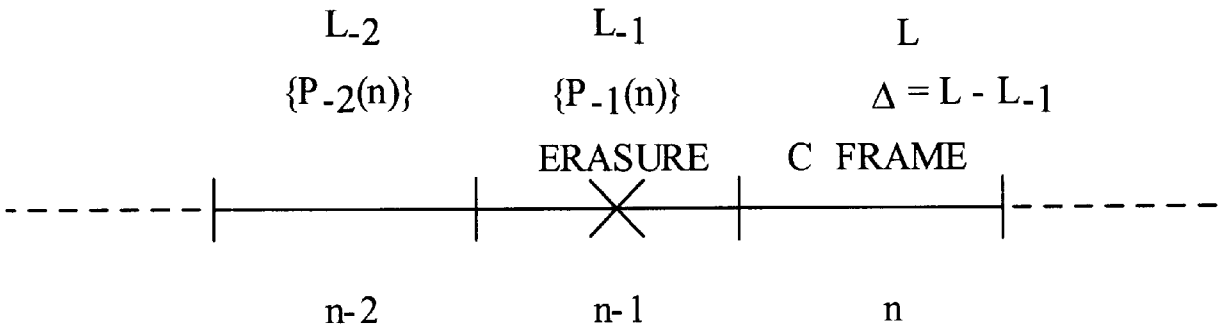
FIG. 7 illustrates a first frame erasure processing scheme that can be used in the decoder/receiver portion of the speech coder of FIG. 5.

As illustrated in the example of FIG. 7, if the packet of the previous frame, frame n–1, is lost, the pitch memory contribution, $\{P_{-2}(n)\}$, after decoding the frame received prior to the previous frame, frame n–2, is stored in the coder memory (not shown). The pitch lag value for frame n–2, $L_{-2}$, is also stored in the coder memory. If the current frame, frame n, is encoded by coder C, frame n may be called a C frame. Coder C can restore the previous pitch lag value, $L_{-1}$, from the delta pitch value, $\Delta$, using the equation $L_{-1}=L-\Delta$. Hence, a correct pitch contour can be reconstructed with the values $L_{-1}$ and $L_{-2}$. The adaptive codebook contribution for frame n–1 can be repaired given the right pitch contour, and is subsequently used to generate the adaptive codebook contribution for frame n. Those skilled in the art understand that such a scheme is used in some conventional coders such as the EVRC coder.

Figure 8:
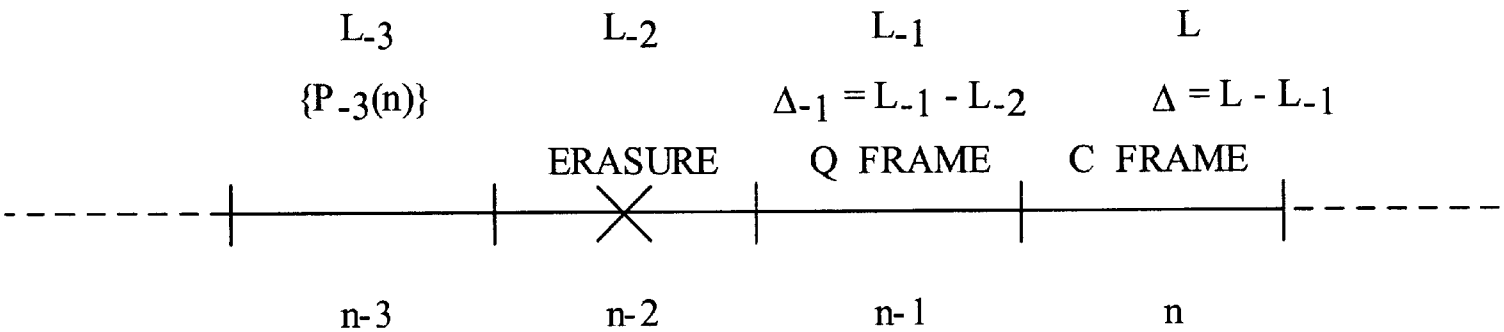
FIG. 8 illustrates a second frame erasure processing scheme tailored to a variable-rate speech coder, which can be used in the decoder/receiver portion of the speech coder of FIG. 5.

In accordance with one embodiment, frame erasure performance in a variable-rate speech coding system using the above-described two types of coders (coder C and coder Q) is enhanced as described below. As illustrated in the example of FIG. 8, a variable-rate coding system may be designed to use both coder C and coder Q. The current frame, frame n, is a C frame and its packet is not lost. The previous frame, frame n–1, is a Q frame. The packet for the frame preceding the Q frame (i.e., the packet for frame n–2) was lost.

In frame erasure processing for frame n–2, the pitch memory contribution, $\{P_{-3}(n)\}$, after decoding frame n–3 is stored in the coder memory (not shown). The pitch lag value for frame n–3, $L_{-3}$, is also stored in the coder memory. The pitch lag value for frame n–1, $L_{-1}$, can be recovered by using the delta pitch lag value, $\Delta$ (which is equal to $L-L_{-1}$), in the C frame packet according to the equation $L_{-1}=L-\Delta$. Frame n–1 is a Q frame with an associated encoded delta pitch lag value of its own, $\Delta_{-1}$, equal to $L_{-1}-L_{-2}$. Hence, the pitch lag value for the erasure frame, frame n–2, $L_{-2}$, can be recovered according to the equation $L_{-2}=L_{-1}-\Delta_{-1}$. With the correct pitches lag values for frame n–2 and frame n–1, pitch contours for these frames can advantageously be reconstructed and the adaptive codebook contribution can be repaired accordingly. Hence, the C frame will have the improved pitch memory required to compute the adaptive codebook contribution for its quantized LP residual signal (or speech signal). This method can be readily extended to allow for the existence of multiple Q frames between the erasure frame and the C frame as can be appreciated by those skilled in the art.

Figure 9:
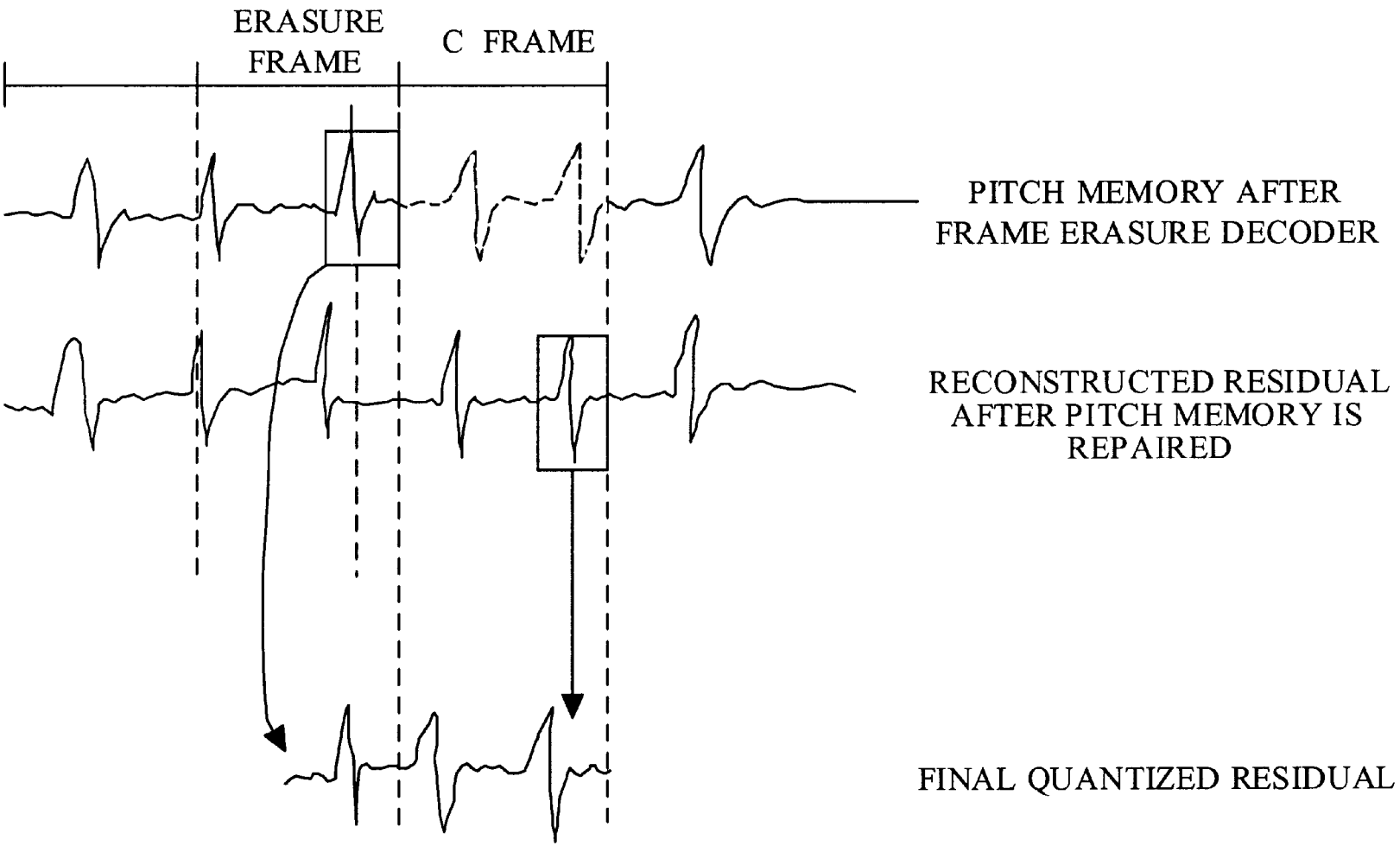
FIG. 9 plots signal amplitude versus time for various linear predictive (LP) residue waveforms to illustrate a frame erasure processing scheme that can be used to smooth a transition between a corrupted frame and a good frame.

As shown graphically in FIG. 9, when a frame is erased, the erasure decoder (e.g., element 418 of FIG. 5) reconstructs the quantized LP residual (or speech signal) without the exact information of the frame. If the pitch contour and the pitch memory of the erased frame were restored in accordance with the above-described method for reconstructing the quantized LP residual (or speech signal) of the current frame, the resultant quantized LP residual (or speech signal) would be different than that had the corrupted pitch memory been used. Such a change in the coder pitch memory will result in a discontinuity in quantized residuals (or speech signals) across frames. Hence, a transition sound, or click, is often heard in conventional speech coders such as the EVRC coder.

In accordance with one embodiment, pitch period prototypes are extracted from the corrupted pitch memory prior to repair. The LP residual (or speech signal) for the current frame is also extracted in accordance with a normal dequantization process. The quantized LP residual (or speech signal) for the current frame is then reconstructed in accordance with a waveform interpolation (WI) method. In a particular embodiment, the WI method operates according to the PPP encoding mode described above. This method advantageously serves to smooth the discontinuity described above and to further enhance the frame erasure performance of the speech coder. Such a WI scheme can be used whenever the pitch memory is repaired due to erasure processing regardless of the techniques used to accomplish the repair (including, but not limited to, e.g., the techniques described in the previously hereinabove).

Figure 10:
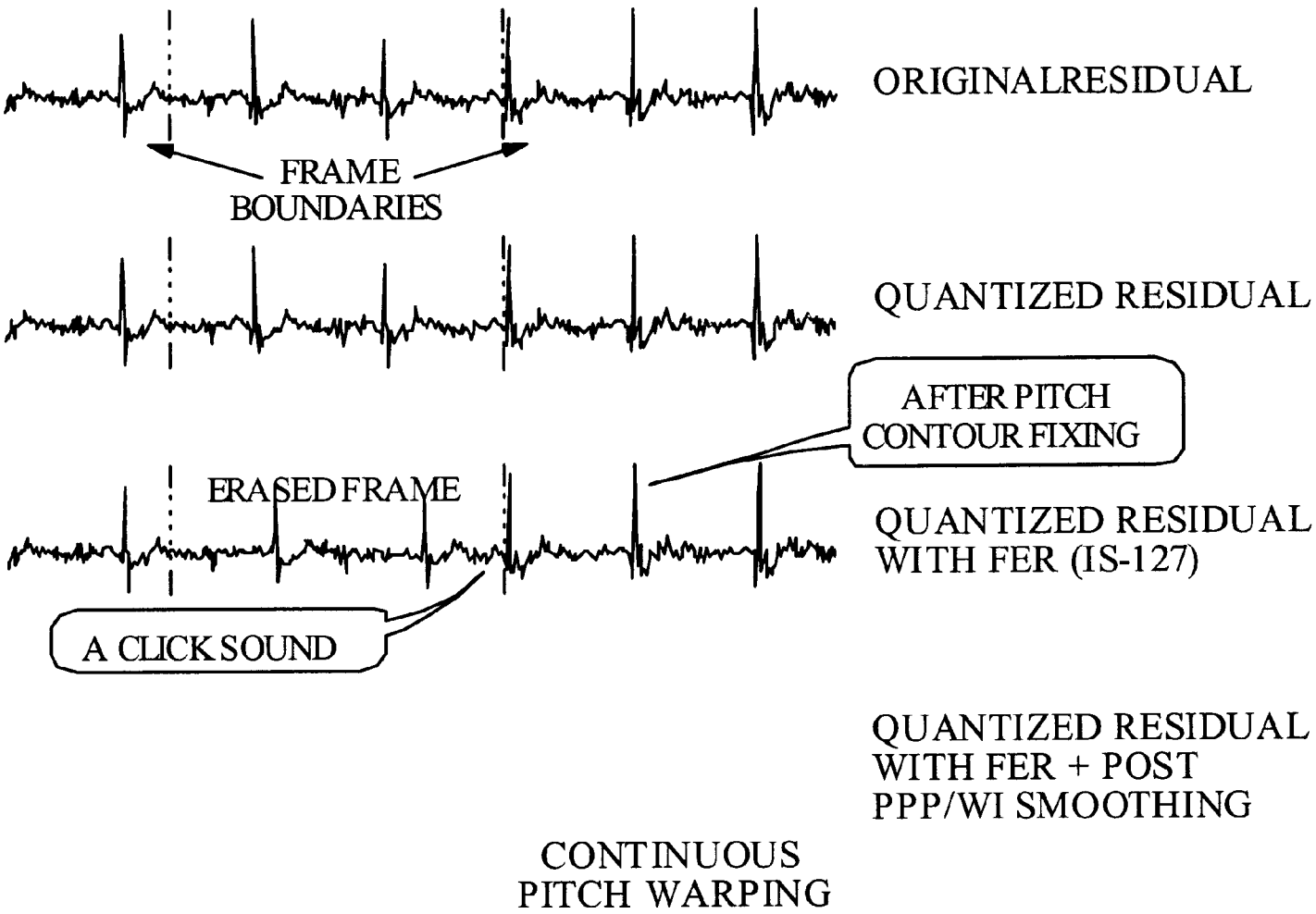
FIG. 10 plots signal amplitude versus time for various LP residue waveforms to illustrate the benefits of the frame erasure processing scheme depicted in FIG. 9.
Figure 11:
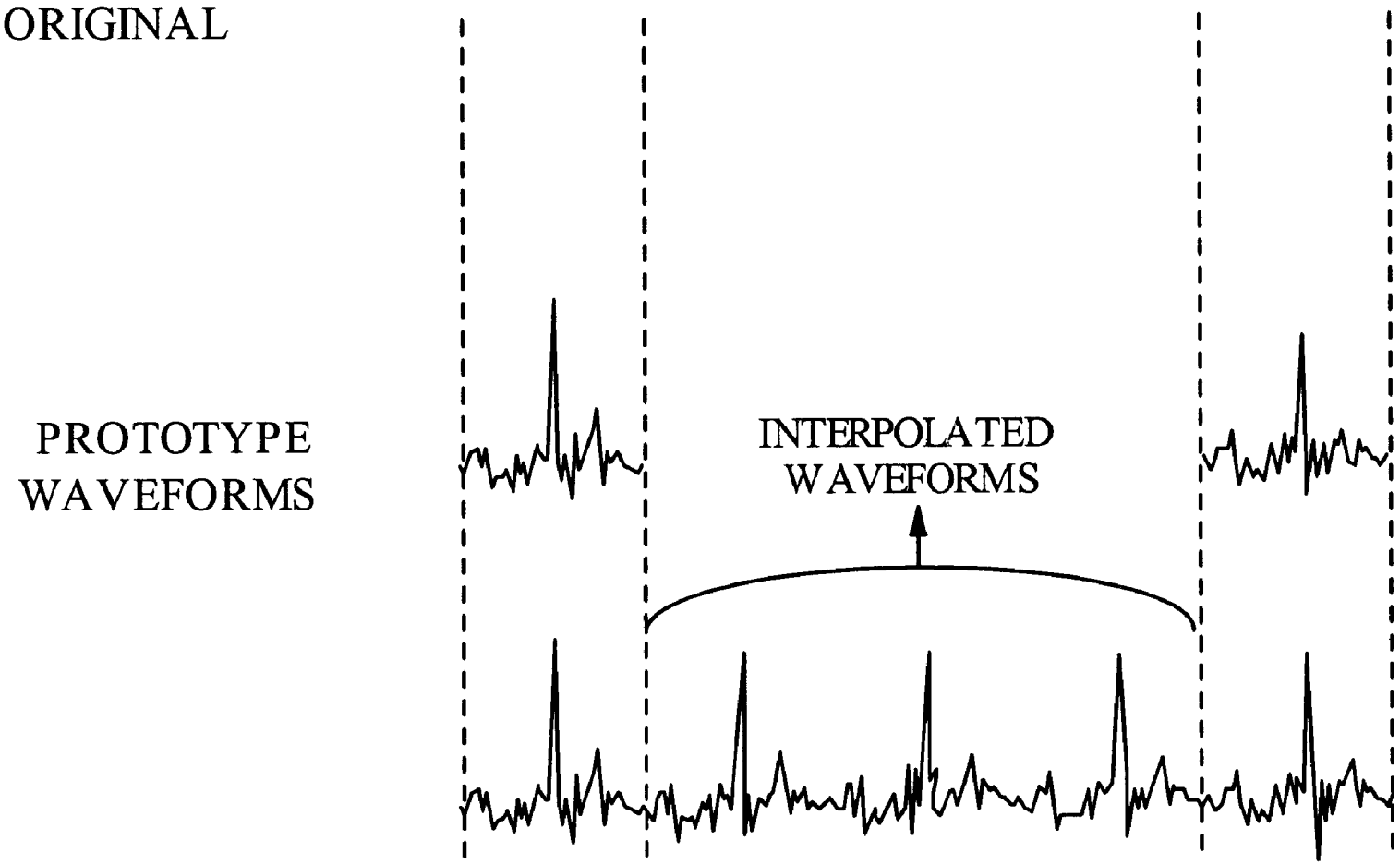
FIG. 11 plots signal amplitude versus time for various waveforms to illustrate a pitch period prototype or waveform interpolation coding technique.

The graphs of FIG. 10 illustrate the difference in appearance between an LP residual signal having been adjusted in accordance with conventional techniques, producing an audible click, and an LP residual signal having been subsequently smoothed in accordance with the above-described WI smoothing scheme. The graphs of FIG. 11 illustrate principles of a PPP or WI coding technique.

Figure 12:
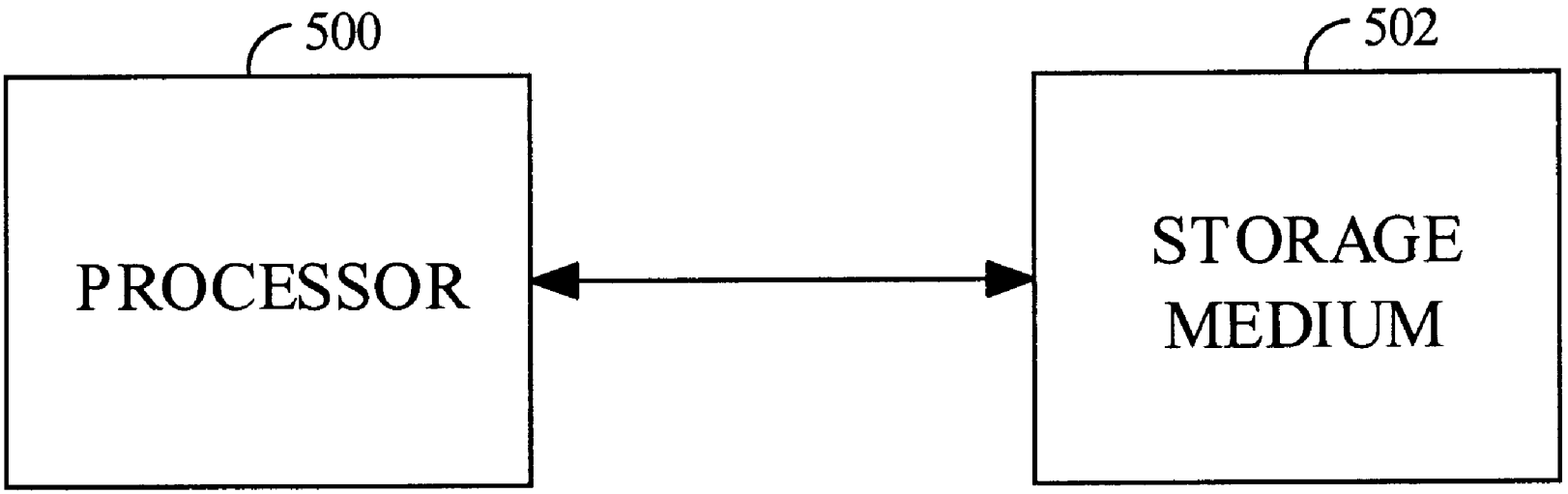
FIG. 12 is a block diagram of a processor coupled to a storage medium.

Thus, a novel and improved frame erasure compensation method in a variable-rate speech coder has been described. Those of skill in the art would understand that the data, instructions, commands, information, signals, bits, symbols, and chips that may be referenced throughout the above description are advantageously represented by voltages, currents, electromagnetic waves, magnetic fields or particles, optical fields or particles, or any combination thereof. Those of skill would further appreciate that the various illustrative logical blocks, modules, circuits, and algorithm steps described in connection with the embodiments disclosed herein may be implemented as electronic hardware, computer software, or combinations of both. The various illustrative components, blocks, modules, circuits, and steps have been described generally in terms of their functionality. Whether the functionality is implemented as hardware or software depends upon the particular application and design constraints imposed on the overall system. Skilled artisans recognize the interchangeability of hardware and software under these circumstances, and how best to implement the described functionality for each particular application. As examples, the various illustrative logical blocks, modules, circuits, and algorithm steps described in connection with the embodiments disclosed herein may be implemented or performed with a digital signal processor (DSP), an application specific integrated circuit (ASIC), a field programmable gate array (FPGA) or other programmable logic device, discrete gate or transistor logic, discrete hardware components such as, e.g., registers and FIFO, a processor executing a set of firmware instructions, any conventional programmable software module and a processor, or any combination thereof designed to perform the functions described herein. The processor may advantageously be a microprocessor, but in the alternative, the processor may be any conventional processor, controller, microcontroller, or state machine. The software module could reside in RAM memory, flash memory, ROM memory, EPROM memory, EEPROM memory, registers, hard disk, a removable disk, a CD-ROM, or any other form of storage medium known in the art. As illustrated in FIG. 12, an exemplary processor 500 is advantageously coupled to a storage medium 502 so as to read information from, and write information to, the storage medium 502. In the alternative, the storage medium 502 may be integral to the processor 500. The processor 500 and the storage medium 502 may reside in an ASIC (not shown). The ASIC may reside in a telephone (not shown). In the alternative, the processor 500 and the storage medium 502 may reside in a telephone. The processor 500 may be implemented as a combination of a DSP and a microprocessor, or as two microprocessors in conjunction with a DSP core, etc.

Preferred embodiments of the present invention have thus been shown and described. It would be apparent to one of ordinary skill in the art, however, that numerous alterations may be made to the embodiments herein disclosed without departing from the spirit or scope of the invention. Therefore, the present invention is not to be limited except in accordance with the following claims.

What is claimed is:

1. A method of compensating for a frame erasure in a variable rate speech coder, comprising:

dequantizing a pitch lag value and a first delta value for a current frame processed after an erased frame is declared, the first delta value being equal to the difference between the pitch lag value for the current frame and a pitch lag value for a frame immediately preceding the current frame, the current frame encoded according to a first encoding mode;

dequantizing at least one delta value for at least one frame prior to the current frame and after the frame erasure, wherein the at least one delta value is equal to the difference between a pitch lag value for the at least one frame and a pitch lag value for a frame immediately preceding the at least one frame, the at least one frame encoded according to a second encoding mode different from the first encoding mode; and subtracting each delta value from the pitch lag value for the current frame to generate a pitch lag value for the erased frame.

2. The method of claim 1, further comprising reconstructing the erased frame to generate a reconstructed frame.

3. The method of claim 2, further comprising performing a waveform interpolation to smooth any discontinuity existing between the current frame and the reconstructed frame.

4. The method of claim 1, wherein dequantizing the pitch lag value and a first delta value for a current frame is performed in accordance with a relatively nonpredictive coding mode.

5. The method of claim 1, wherein dequantizing at least one delta value is performed in accordance with a relatively predictive coding mode.

6. A variable rate speech coder configured to compensate for a frame erasure, comprising:

means for decoding a pitch lag value and a first delta value for a current frame processed after an erased frame is declared, the first delta value being equal to the difference between the pitch lag value for the current frame and a pitch lag value for a frame immediately preceding the current frame, the current frame being encoded according to a first encoding mode;

means for decoding at least one delta value for at least one frame prior to the current frame and after the frame erasure, wherein the at least one delta value is equal to the difference between a pitch lag value for the at least one frame and a pitch lag value for a frame immediately preceding the at least one frame, the at least one frame encoded according to a second encoding mode different from the first encoding mode; and means for subtracting each delta value from the pitch lag value for the current frame to generate a pitch lag value for the erased frame.

7. The speech coder of claim 6, further comprising means for reconstructing the erased frame to generate a reconstructed frame.

8. The speech coder of claim 7, further comprising means for performing a waveform interpolation to smooth any discontinuity existing between the current frame and the reconstructed frame.

9. The speech coder of claim 6, wherein the means for decoding a pitch lag value and a first delta value comprises means for dequantizing in accordance with a relatively nonpredictive coding mode.

10. The speech coder of claim 6, wherein the means for decoding at least one delta value comprises means for dequantizing in accordance with a relatively predictive coding mode.

11. A subscriber unit configured to compensate for a frame erasure, comprising:

a first speech coder configured to decode a pitch lag value and a first delta value for a current frame processed after an erased frame is declared, the first delta value being equal to the difference between the pitch lag value for the current frame and a pitch lag value for a frame immediately preceding the current frame, the current frame encoded according to a first encoding mode;

a second speech coder configured to decode at least one delta value for at least one frame prior to the current frame and after the frame erasure, wherein the at least one delta value is equal to the difference between a pitch lag value for the at least one frame and a pitch lag value for a frame immediately preceding the at least one frame, the at least one frame encoded according to a second encoding mode different from the first encoding mode; and a control processor coupled to the first and second speech coders and configured to subtract each delta value from the pitch lag value for the current frame to generate a pitch lag value for the erased frame.

12. The subscriber unit of claim 11, wherein the control processor is further configured to reconstruct the erased frame to generate a reconstructed frame.

13. The subscriber unit of claim 12, wherein the control processor is further configured to perform a waveform interpolation to smooth any discontinuity existing between the current frame and the reconstructed frame.

14. The subscriber unit of claim 11, wherein the first speech coder is configured to decode in accordance with a relatively nonpredictive coding mode.

15. The subscriber unit of claim 11, wherein the second speech coder is configured to decode in accordance with a relatively predictive coding mode.

16. The subscriber unit as in claim 11, further comprising:

a switching means coupled to the control processor, and adapted to:

determine an encoding mode of each received frame; and couple to the corresponding one of the first and second speech coders.

17. The subscriber unit as in claim 16, further comprising:

frame erasure detection means coupled to the control processor.

18. An infrastructure element configured to compensate for a frame erasure, comprising:

a processor; and a storage medium coupled to the processor and containing a set of instructions executable by the processor to dequantize a pitch lag value and a first delta value for a current frame processed after an erased frame is declared, the first delta value being equal to the difference between the pitch lag value for the current frame and a pitch lag value for a frame immediately preceding the current frame, dequantize at least one delta value for at least one frame prior to the current frame and after the frame erasure, wherein the at least one delta value is equal to the difference between a pitch lag value for the at least one frame and a pitch lag value for a frame immediately preceding the at least one frame, and subtract each delta value from the pitch lag value for the current frame to generate a pitch lag value for the erased frame, wherein the current frame is encoded according to a first encoding mode, and the at least one frame is encoded according to a second encoding mode different from the first encoding mode.

19. The infrastructure element of claim 18, wherein the set of instructions is further executable by the processor to reconstruct the erased frame to generate a reconstructed frame.

20. The infrastructure element of claim 19, wherein the set of instructions is further executable by the processor to perform a waveform interpolation to smooth any discontinuity existing between the current frame and the reconstructed frame.

21. The infrastructure element of claim 18, wherein the set of instructions is further executable by the processor to dequantize the pitch lag value and the first delta value for the current frame in accordance with a relatively nonpredictive coding mode.

22. The infrastructure element of claim 18, wherein the set of instructions is further executable by the processor to dequantize the at least one delta value for at least one frame prior to the current frame and after the frame erasure in accordance with a relatively predictive coding mode.

23. A method of compensating for a frame erasure in a variable rate speech decoder, wherein frames received at the speech decoder include a delta value, each delta value corresponding to a change in pitch lag from an immediately preceding frame, the method comprising:

declaring an erased frame;

decoding a first delta value for a first frame, the first frame being received after the erased frame is declared, wherein the first frame is encoded using a first encoding mode;

decoding a current pitch lag value and a current delta value for a current frame processed after receiving the first frame, wherein the current frame is encoded using a second encoding mode different from the first encoding mode;

generating a first pitch lag value for the first frame based on the first delta value and the current pitch lag value; and subtracting the first and current delta values from the current pitch lag value for the current frame to generate a pitch lag value for the erased frame.

24. The method as in claim 23, wherein the second encoding mode is used to encode relatively nonperiodic speech.

25. The method as in claim 24, wherein the first encoding mode is used to encode relatively periodic speech.

26. The method as in claim 25, wherein the first encoding mode provides a first bit rate encoding and the second encoding mode provides a second bit rate encoding, wherein the first bit rate is less than the second bit rate.

27. An apparatus for compensating for a frame erasure in a speech decoder, wherein frames received at the speech decoder include a delta value, each delta value corresponding to a change in pitch lag from an immediately preceding frame, the apparatus comprising:

means for declaring an erased frame;

means for decoding a first delta value for a first frame, the first frame being received after the erased frame is declared, wherein the first frame is encoded using a first encoding mode;

means for decoding a current pitch lag value and a current delta value for a current frame processed after receiving the first frame, wherein the current frame is encoded using a second encoding mode different from the first encoding mode;

means for generating a first pitch lag value for the first frame based on the first delta value and the current pitch lag value; and means for subtracting the first and current delta values from the current pitch lag value for the current frame to generate a pitch lag value for the erased frame.

* * * * *